US010330102B2

(12) United States Patent
Ishikawa

(10) Patent No.: US 10,330,102 B2
(45) Date of Patent: Jun. 25, 2019

(54) CENTRIFUGAL COMPRESSOR AND TURBOCHARGER

(71) Applicant: IHI Corporation, Koto-ku (JP)

(72) Inventor: Kazue Ishikawa, Tokyo (JP)

(73) Assignee: IHI Corporation, Koto-ku (JP)

( * ) Notice: Subject to any disclaimer, the term of this patent is extended or adjusted under 35 U.S.C. 154(b) by 661 days.

(21) Appl. No.: 14/983,655

(22) Filed: Dec. 30, 2015

(65) Prior Publication Data

US 2016/0108921 A1 Apr. 21, 2016

Related U.S. Application Data

(63) Continuation of application No. PCT/JP2014/076028, filed on Sep. 30, 2014.

(30) Foreign Application Priority Data

Oct. 31, 2013 (JP) ..... 2013-226828

(51) Int. Cl.

| | |
|---|---|
| ***F04D 29/44*** | (2006.01) |
| ***F04D 17/10*** | (2006.01) |
| ***F04D 29/28*** | (2006.01) |
| ***F04D 29/42*** | (2006.01) |

(52) U.S. Cl.

CPC ..... *F04D 17/10* (2013.01); *F04D 29/284* (2013.01); *F04D 29/422* (2013.01); *F04D 29/4206* (2013.01); *F04D 29/441* (2013.01); *F05D 2220/40* (2013.01); *F05D 2250/52* (2013.01)

(58) Field of Classification Search

CPC ..... F04D 29/44; F04D 29/442

See application file for complete search history.

(56) References Cited

U.S. PATENT DOCUMENTS

| | | | | |
|---|---|---|---|---|
| 1,065,732 | A * | 6/1913 | Schneible | F04D 17/168 415/71 |
| 4,824,323 | A | 4/1989 | Griepentrog et al. | |
| 5,143,514 | A | 9/1992 | Adachi | |
| 2009/0060731 | A1 * | 3/2009 | Chen | F04D 29/441 415/204 |

(Continued)

FOREIGN PATENT DOCUMENTS

| | | |
|---|---|---|
| CN | 1048251 A | 1/1991 |
| JP | 63-253197 | 10/1988 |

(Continued)

OTHER PUBLICATIONS

International Search Report dated Dec. 22, 2014 in PCT/JP2014/076028, filed Sep. 30, 2014 (with English Translation).

(Continued)

*Primary Examiner* — Kayla McCaffrey

(74) *Attorney, Agent, or Firm* — Oblon, McClelland, Maier & Neustadt, L.L.P.

(57) ABSTRACT

A centrifugal compressor includes a housing, a wheel rotatably provided in the housing, a diffuser that decelerates compressed air and increases its pressure, a throttle portion provided between the wheel and the diffuser, and a scroll. The center of the inner peripheral edge of the diffuser is eccentric toward an area located on a winding start side of the scroll from the shaft center of the wheel toward an area.

6 Claims, 4 Drawing Sheets

(56) References Cited

U.S. PATENT DOCUMENTS

2010/0178163 A1* 7/2010 Dettmann ..... F04D 29/444
415/203

FOREIGN PATENT DOCUMENTS

| | | |
|---|---|---|
| JP | 3-54395 | 3/1991 |
| JP | 4-103293 | 9/1992 |
| JP | 10-176699 | 6/1998 |
| JP | 2008-215250 | 9/2008 |
| JP | 2009-36099 | 2/2009 |
| JP | 2011-89490 | 5/2011 |
| JP | 2012-184706 | 9/2012 |
| JP | 2012-197749 | 10/2012 |
| JP | 2012-246931 | 12/2012 |
| JP | 2013-119828 | 6/2013 |

OTHER PUBLICATIONS

Written Opinion dated Dec. 22, 2014 in PCT/JP2014/076028, filed Sep. 30, 2014.

Combined Chinese Office Action and Search Report dated Dec. 7, 2016 in Patent Application No. 201480041571.8 (with English Translation of Categories of Cited Documents).

* cited by examiner

CENTRIFUGAL COMPRESSOR AND TURBOCHARGER

CROSS REFERENCE TO RELATED APPLICATIONS

This application is a continuation application of International Application No. PCT/JP2014/076028, filed on Sep. 30, 2014, which claims priority to Japanese Patent Application No. 2013-226828, filed on Oct. 31, 2013, the entire contents of which are incorporated by reference herein.

BACKGROUND

1. Technical Field

The present disclosure relates to a centrifugal compressor that compresses a fluid including a gas such as air by using centrifugal force, and a turbocharger.

2. Description of the Related Art

In recent years, various types of research and development have been performed on centrifugal compressors used in turbochargers, gas turbines, industrial pneumatic devices, and the like (see Japanese Patent Laid-Open Publication Nos. 2012-246931, 2012-197749, and 2011-89490).

Centrifugal compressors generally include a housing. This housing has a shroud provided therein. The housing has a wheel provided therein so as to be rotatable around the shaft center thereof. The wheel includes a disk. A hub surface of this disk extends radially outwardly from one side of the turbine wheel in the axial direction. Furthermore, the hub surface of the disk includes a plurality of blades integrally provided at intervals in the circumferential direction. A tip end edge of each of the blades extends along the shroud of the housing.

An introduction flow passage (introduction port) for introducing a fluid into the housing is formed on the inlet side of the wheel in the housing. Furthermore, a ring-shaped diffuser (diffuser flow passage) that decelerates a compressed fluid to increase its pressures is formed on the outlet side of the wheel in the housing. Note that the inlet side and the outlet side mean an upstream side and a downstream side, respectively, when viewed in a flowing direction of a main flow.

A throttle portion is provided between the wheel and the diffuser in the housing. The throttle portion is formed so as to communicate with the diffuser. Furthermore, the width of the flow passage of the throttle portion gradually reduces along the flowing direction of the main flow. A scroll (scrolling flow passage) having a spiral shape is formed on the outlet side of the diffuser in the housing so as to communicate with the diffuser. In addition, a discharge flow passage (discharge port) for discharging the compressed fluid to the outside of the housing is formed at an appropriate position in the housing so as to communicate with the scroll. Note that the discharge flow passage and the winding start side of the scroll are separated by a tongue portion of the housing.

SUMMARY

Tests of simulating real operational conditions were carried out to measure static pressures at the exit of the diffuser. As a result, it is confirmed that, as illustrated in FIG. 4, the variation in static pressures at the exit of the diffuser in the circumferential direction is large on a low flow rate side (surge side) although the variation is small on a high flow rate side (choke side). Specifically, when a line passing through the tip end of the tongue portion and the shaft center of the wheel is assumed to be a reference line, static pressures at the exit of the diffuser on the low flow rate side become high in a range in the vicinity of 30 to 135 degrees from the reference line in the rotational direction of the wheel, and become low in a range in the vicinity of 210 to 315 degrees from the reference line. In other words, it is confirmed that static pressures at the exit of the diffuser on the low flow rate side are high in an area (first area) located closer to the immediate front side than the tip end of the tongue portion in the rotational direction of the wheel, and are low in an area (second area) located on the opposite side to the first area across the shaft center of the wheel. If variation in the static pressures at the exit of the diffuser on the low flow rate side in the circumference direction further increases, this leads to an occurrence of surging of the centrifugal compressor. In such a situation, it becomes difficult to extend the operational range of the centrifugal compressor to the low flow rate side.

Note that FIG. 4 is a diagram illustrating a relationship between the angle position from the reference line in the rotational direction of the wheel and the recovery ratio (ratio of the static pressure at the exit of the diffuser relative to the total pressure at the entrance of the wheel) of static pressures at the exit of the diffuser.

An object of the present disclosure is to provide a centrifugal compressor that can reduce variation in static pressures at the exit of the diffuser in the circumferential direction on the low flow rate side, and a turbocharger.

A first aspect of the present disclosure is a centrifugal compressor configured to compress a fluid by using a centrifugal force, including: a housing provided with a shroud therein; a wheel rotatably provided in the housing; an introduction flow passage provided on an inlet side of the wheel in the housing, and introduces the fluid into the housing; an annular diffuser provided on an outlet side of the wheel in the housing; an annular throttle portion provided between the wheel and the diffuser to communicate with the diffuser, the throttle portion including a flow passage width gradually reduced along a flowing direction of a main flow; a scroll having a spiral shape, provided on an outlet side of the diffuser to communicate with the diffuser; a discharge flow passage provided to communicate with a winding end side of the scroll, the discharge flow passage configured to discharge the fluid to an outside of the housing; and a tongue portion separating the discharge flow passage and a winding start side of the scroll, wherein a flow passage length of the diffuser increases from a first area to a second area, the first area being located on the winding start side of the scroll, the second area being located on an opposite side to the first area across a shaft center of the wheel and being located closer to the winding end side than the first area.

Note that, in the Description and Claims of the present application, the term "provided" not only means "directly provided" but also means "indirectly provided via other elements," and the term "integrally provided" includes a meaning "integrally formed." In addition, the "axial direction" represents the axial direction of the wheel, and the "radial direction" represents the radial direction of the wheel.

A second aspect of the present disclosure is a turbocharger, and the turbocharger includes the centrifugal compressor according to the first aspect.

According to the present disclosure, it is possible to cancel a tendency concerning the static pressure at the exit of the diffuser on the low flow rate side, and to reduce variation in the static pressure at the exit of the diffuser in the circumferential direction on the low flow rate side. Therefore, surge of the centrifugal compressor can be sufficiently suppressed, and thus an operational range of the centrifugal compressor can be extended to the low flow rate side.

DESCRIPTION OF THE EMBODIMENTS

Figure 1:
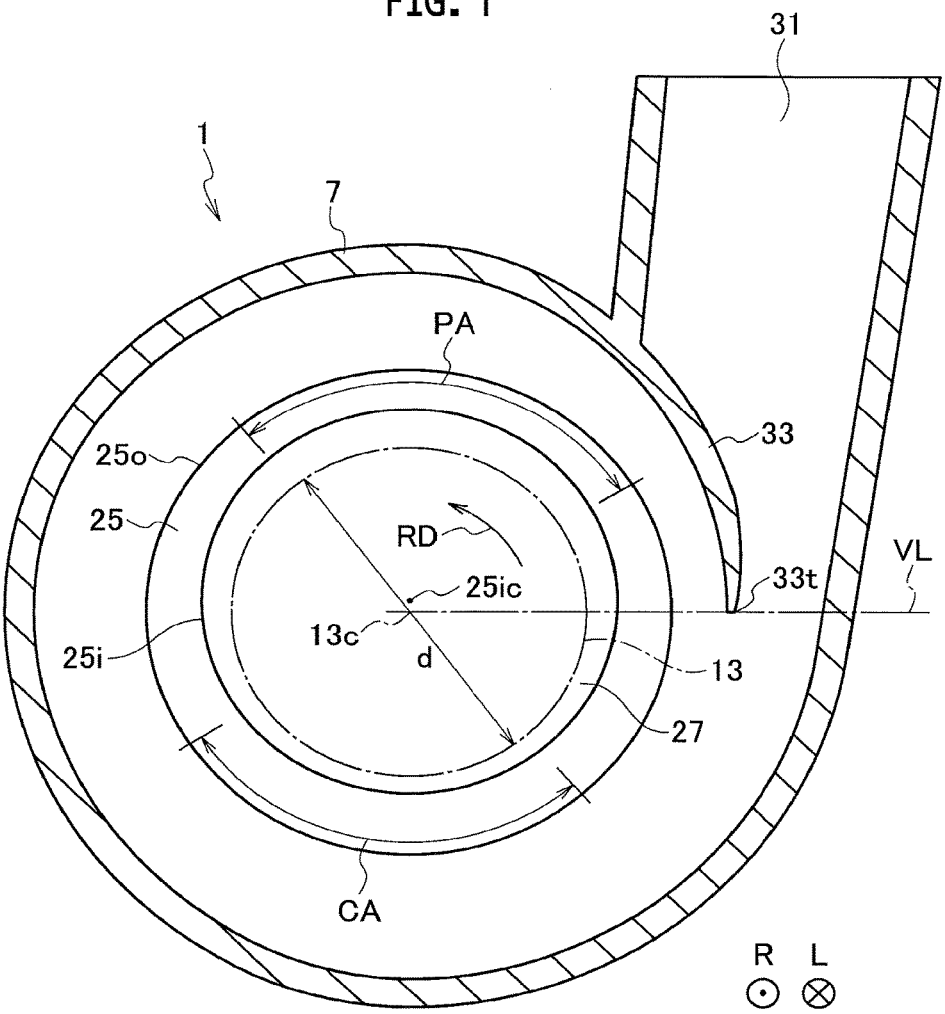
FIG. 1 is a cross-sectional view taken along the I-I line in FIG. 3.

An embodiment according to the present disclosure will be described with reference to FIG. 1 to FIG. 3. Note that, as indicated in the drawings, the "L" represents the left direction, and the "R" indicates the right direction.

The centrifugal compressor compresses air by using a centrifugal force. As illustrated in FIG. 1 and FIG. 3, a centrifugal compressor 1 according to the present embodiment is used in a turbocharger 3.

The centrifugal compressor 1 includes a housing (compressor housing) 5. The housing 5 includes a housing body 7 having a shroud 7*s* provided therein, and a seal plate 9 that is provided on the right side of the housing body 7 and suppresses air leakage. The seal plate 9 is integrally connected with another housing (bearing housing) 11 in the turbocharger 3.

A wheel (compressor wheel) 13 is provided in the housing 5 so as to be rotatable around the shaft center 13*c* thereof. The wheel 13 is integrally connected with the left end portion of a rotating shaft 15 rotatably provided to the housing 11 via a plurality of bearings (not illustrated). Furthermore, the wheel 13 includes a disk 17. A hub surface 17*h* of the disk 17 extends outwardly in the radial direction (radial direction of the wheel 13) from the left direction (one side of the wheel 13 in the axial direction). A plurality of long blades (full blades) 19 is formed integrally with the hub surface 17*h* of the disk 17 at intervals in the circumferential direction. The tip end edge 19*t* of each of the long blades 19 extends along the shroud 7*s* of the housing body 7. Moreover, a short blade (splitter blade) 21 is provided integrally with the hub surface 17*h*, between long blades 19 adjacent in the circumferential direction. The short blade 21 has an axial length shorter than the long blade 19. In addition, the tip end edge 21*t* of each of the short blades 21 extends along the shroud 7*s* of the housing body 7. Note that it may also be possible to use blades (not illustrated) each having the same axial length, in place of using the blades having different axial lengths (the long blades 19 and the short blades 21).

An introduction flow passage (inlet) 23 is formed on the inlet side (upstream side when viewed in the flowing direction of the main flow) of the wheel 13 in the housing body 7. The introduction flow passage 23 introduces air into the housing 5. The introduction flow passage 23 is connected with an air cleaner (not illustrated) that cleans air. Furthermore, a diffuser (diffuser flow passage) 25 is formed on the outlet side (downstream side when viewed in the flowing direction of the main flow) of the wheel 13 in the housing 5. The diffuser 25 is annularly formed into a ring shape, and decelerates the compressed air to increase pressures of the compressed air. The diffuser 25 includes a shroud-side wall surface 25*s* constituted by part of the housing body 7, and a hub-side wall surface 25*h* constituted by part of the seal plate 9. Note that the shroud-side wall surface 25*s* represents a wall surface located on the side of a surface obtained by extending the shroud 7*s* of the housing body 7 outwardly in the radial direction thereof, and furthermore, the hub-side wall surface 25*h* represents a wall surface located on the side of a surface obtained by extending the hub surface 17*h* of the disk 17 outwardly in the radial direction thereof.

A throttle portion (throttle flow passage) 27 is formed between the wheel 13 and the diffuser 25 in the housing 5. The throttle portion 27 communicates with the diffuser 25. A flow passage width of the throttle portion 27 in the axial direction is gradually reduced along the flowing direction of the main flow. Furthermore, the scroll (scrolling flow passage) 29 having a spiral shape is formed on the outlet side of the diffuser 25 in the housing 5. The scroll 29 communicates with the diffuser 25. The cross cross-sectional area of the scroll 29 on the winding end side (downstream side) is larger than that on the winding start side (upstream side). Moreover, a discharge flow passage (discharge port) 31 is formed at an appropriate position in the housing body 7. The discharge flow passage 31 discharges the compressed air to the outside of the housing 5. The discharge flow passage 31 communicates with the winding end side of the scroll 29. In addition, the discharge flow passage 31 is connected with an intake manifold (not illustrated) of the engine. Note that the discharge flow passage 31 and the winding start side of the scroll 29 are separated by a tongue portion 33 of the housing body 7.

Figure 2:
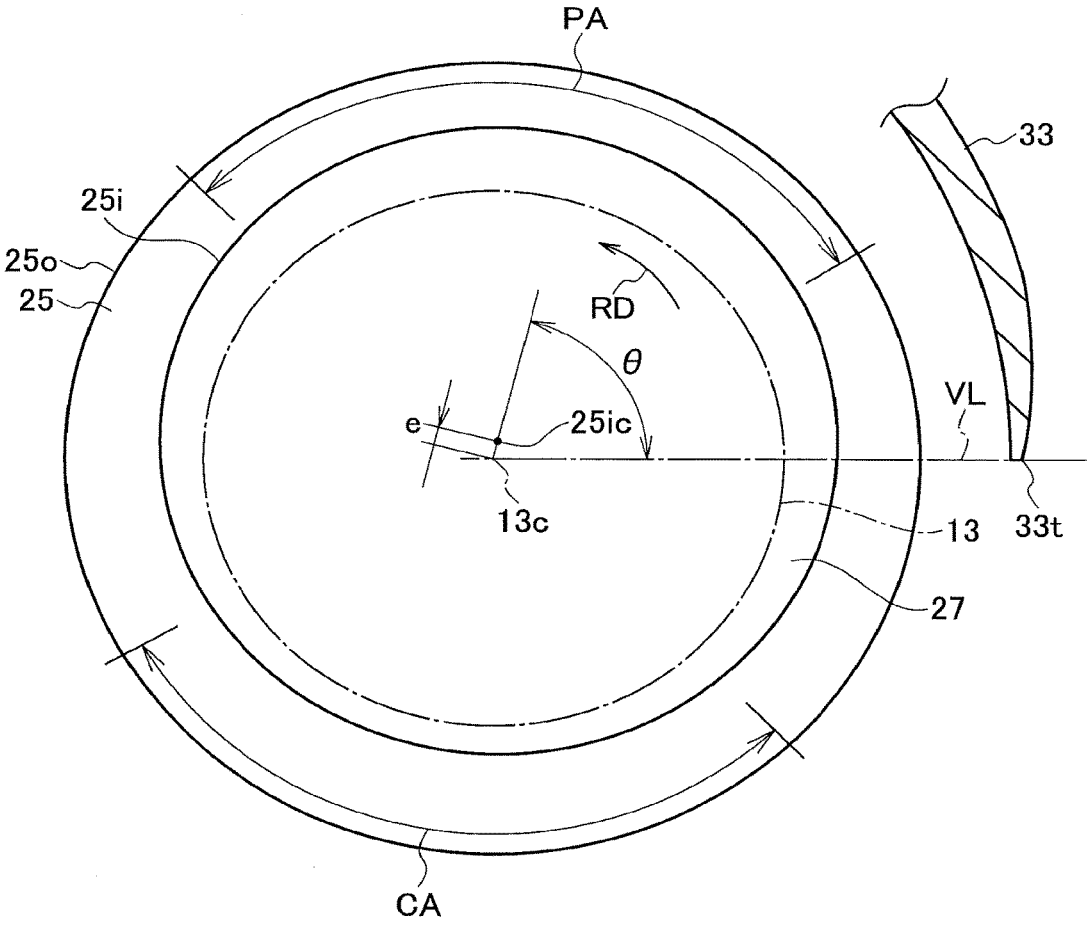
FIG. 2 is a partially enlarged view of FIG. 1 illustrating a relationship between a diffuser and a wheel.
Figure 3:
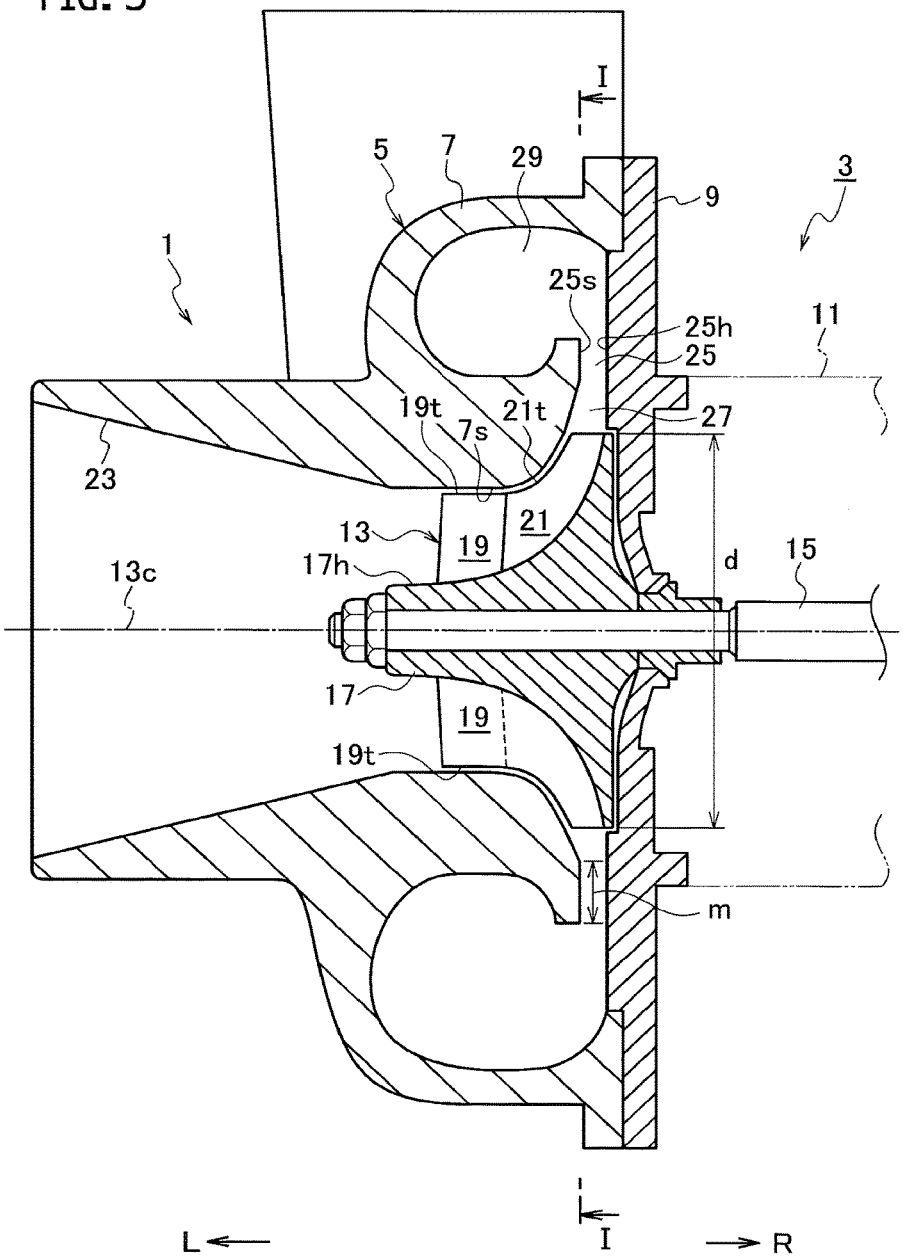
FIG. 3 is an elevation cross-sectional view illustrating a centrifugal compressor according to an embodiment of the present disclosure.

As illustrated in FIG. 1 to FIG. 3, an outer peripheral edge 25*o* of the diffuser 25 is positioned concentrically with the wheel 13. Furthermore, the center (shaft center) 25*ic* of the inner peripheral edge 25*i* (outer peripheral edge of the throttle portion 27) of the diffuser 25 is eccentric with respect to the shaft center 13*c* of the wheel 13, in a direction toward an area (area located on the immediate front side, first area) PA located closer to the immediate front side (on the side of the area PA) than the tip end 33*t* of the tongue portion 33 when viewed in the rotational direction RD of the wheel 13. In other words, the flow passage length (length in the radial direction) m of the diffuser 25 gradually increases from the area PA toward an area (opposite area, second area) CA located on the side opposite to the area PA with the shaft center 13*c* of the wheel 13 being the center thereof. Furthermore, in other words, the area PA in the diffuser 25 is located closer to the winding start side of the scroll 29. On the other hand, the area CA in the diffuser 25 is located on the opposite side to the area PA across the shaft center 13*c* of the wheel 13, and is located closer to the winding end side of the scroll 29 than the area PA. The flow passage length of the diffuser 25 increases from this area PA to the area CA.

Here, on the assumption that a line passing through the tip end 33*t* of the tongue portion 33 and the shaft center 13*c* of the wheel 13 is a reference line VL, an angle at a given position from the reference line VL in the rotational direction RD is defined as an eccentric angle, and a distance from the shaft center 13*c* is defined as an eccentric amount. Under these definitions, the center 25*ic* of the inner peripheral edge 25*i* of the diffuser 25 is set to have the eccentric angle θ in a range of 45 to 115 degrees. In this set range, the static-pressure recovery ratio (static-pressure increase ratio) in the area PA in the diffuser 25 is more likely to be suppressed, and the static-pressure recovery ratio in the opposite area CA in the diffuser 25 is more likely to be enhanced, as compared with other ranges.

Under the definitions described above, the eccentric amount e of the center 25*ic* of the inner peripheral edge 25*i* of the diffuser 25 is set in a range of 3 to 8% of the maximum diameter d of the wheel 13. The reason why the eccentric amount e of the center 25*ic* of the inner peripheral edge 25*i* of the diffuser 25 is set to be more than or equal to 3% of the maximum diameter d of the wheel 13 is because of sufficiently achieving the effect of suppressing the static-pressure recovery ratio in the area PA in the diffuser 25, and the effect of enhancing the static-pressure recovery ratio in the area CA in the diffuser 25. On the other hand, the reason why the eccentric amount e of the center 25*ic* of the inner peripheral edge 25*i* of the diffuser 25 is set to be less than or equal to 8% of the maximum diameter d of the wheel 13 is because of sufficiently achieving the flow-straightening action of the throttle portion 27.

Note that the shape of the inner peripheral edge 25*i* of the diffuser 25 is not limited to a circle. Namely, it is sufficient that the inner peripheral edge 25*i* has a shape in which the flow passage length m of the diffuser 25 gradually increases from the area PA to the area CA. In other words, as long as the condition described above is satisfied, the curvature of the inner peripheral edge 25*i* in the rotational direction RD may be changed. Also in this case, a group of centers of curvature at each point on the inner peripheral edge 25*i* is eccentric toward the area PA from the shaft center 13*c* of the wheel 13.

Subsequently, the operations and effects of the present embodiment will be described.

The wheel 13 rotates around the shaft center 13*c* thereof integrally with the rotating shaft 15 by drive of a radial turbine (not illustrated) of the turbocharger 3. Air introduced from the introduction flow passage 23 into the housing 5 can be compressed by this rotation of the wheel 13. In addition, the compressed air is straightened by the throttle portion 27, and increases its pressure while decelerating through the diffuser 25. Then, the compressed air passes through the scroll 29, and is discharged from the discharge flow passage 31 to the outside of the housing 5.

Figure 4:
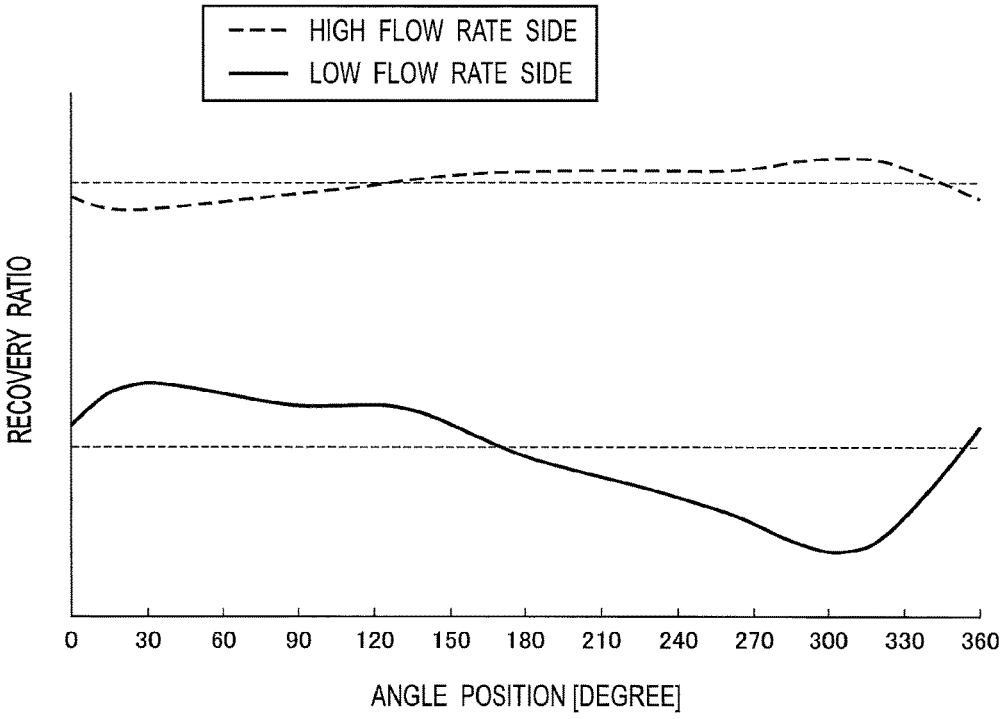
FIG. 4 is a diagram illustrating a relationship between the angle position in the rotational direction of the wheel and the recovery ratio of static pressures at the exit of the diffuser.

The flow passage length m of the diffuser 25 is configured so as to gradually increase from the area PA to the area CA. Accordingly, it is possible to increase the static-pressure recovery ratio in the area CA while suppressing the static-pressure recovery ratio in the area PA. With this configuration, it is possible to cancel a tendency in which the static pressure at the exit of the diffuser 25 on the low flow rate side is high in the area PA and is low in the area CA (refer to FIG. 4), and to reduce change in the static pressure at the exit of the diffuser 25 in the circumferential direction on the low flow rate side.

Furthermore, the shroud-side wall surface 25*s* of the diffuser 25 is formed by part of the housing body 7. Therefore, it is possible to configure the flow passage length m of the diffuser 25 as described above, by adjusting the radial length of the shroud-side wall surface 25*s* of the diffuser 25 along the circumferential direction when the housing body 7 is formed through machine work. In other words, it is possible to reduce the variation in the static pressure at the exit of the diffuser 25 in the circumferential direction on the low flow rate side without making significant design change.

Furthermore, the outer peripheral edge 25*o* of the diffuser 25 is positioned concentrically with the wheel 13. Therefore, although the flow passage length of the diffuser 25 changes in the circumferential direction, it is not necessary to make eccentric the scroll 29 according to the change in the flow passage length of the diffuser 25. Namely, no major design change is necessary for the scroll 29. Moreover, it is possible to minimize the effect on the flow of the fluid flowing in from the diffuser 25 to the scroll 29.

Therefore, according to the present embodiment, it is possible to cancel the tendency concerning the static pressure at the exit of the diffuser 25 on the low flow rate side to thereby reduce the change in the static pressure at the exit of the diffuser 25 in the circumferential direction on the low flow rate side without making major design change, whereby it is possible to sufficiently suppress surges of the centrifugal compressor 1 while reducing cost of manufacturing the centrifugal compressor 1, and to extend the operational range of the centrifugal compressor 1 to the low flow rate side.

Note that the present invention is not limited to the explanation in the above-described embodiment, and the present invention can be carried out in various aspects of; for example, applying the technical idea applied to the centrifugal compressor 1 to gas turbines, industrial pneumatic devices, or the like, of; disposing the diffuser 25 having a plurality of diffuser vanes (not illustrated) at intervals in the circumference direction; and the like. Furthermore, the scope of rights included in the present invention does not only cover the centrifugal compressor 1 but also includes the turbocharge 3 using the centrifugal compressor 1.

What is claimed is:

1. A centrifugal compressor configured to compress a fluid by using a centrifugal force, comprising:

a housing provided with a shroud therein;

a wheel rotatably provided in the housing;

an introduction flow passage provided on an inlet side of the wheel in the housing, and introduces the fluid into the housing;

an annular diffuser provided on an outlet side of the wheel in the housing;

an annular throttle portion provided between the wheel and the diffuser to communicate with the diffuser, the throttle portion including a flow passage width gradually reduced along a flowing direction of a main flow;

a scroll having a spiral shape, provided on an outlet side of the diffuser to communicate with the diffuser;

a discharge flow passage provided to communicate with a winding end side of the scroll, the discharge flow passage configured to discharge the fluid to an outside of the housing; and a tongue portion separating the discharge flow passage and a winding start side of the scroll, wherein a flow passage length of the diffuser in a radial direction of the wheel increases from a first area to a second area, the first area being located on the winding start side of the scroll, the second area being located on an opposite side to the first area across a shaft center of the wheel and being located closer to the winding end side than the first area, and an outer peripheral edge of the diffuser is positioned concentrically with the wheel.

2. The centrifugal compressor according to claim 1, wherein a center of an inner peripheral edge of the diffuser is eccentric toward the first area from the shaft center of the wheel.

3. The centrifugal compressor according to claim 2, wherein when a line passing through a tip end of the tongue portion and the shaft center of the wheel is assumed to be a reference line, and an angle at a given position from the reference line in a rotational direction of the wheel is defined as an eccentric angle, the eccentric angle of the center of the inner peripheral edge of the diffuser is set in a range of 45 to 115 degrees.

4. The centrifugal compressor according to claim 2, when a distance at a given position from the shaft center of the wheel is defined as an eccentric amount, the eccentric amount of the center of the inner peripheral edge of the diffuser is set in a range of 3 to 8% of a maximum diameter of the wheel.

5. The centrifugal compressor according to claim 3, when a distance at a given position from the shaft center of the wheel is defined as an eccentric amount, the eccentric amount of the center of the inner peripheral edge of the diffuser is set in a range of 3 to 8% of a maximum diameter of the wheel.

6. A turbocharger including the centrifugal compressor according to claim 1.

* * * * *